United States Patent [19]

Prenger

[11] 4,262,873

[45] Apr. 21, 1981

[54] PLANT HANGER

[75] Inventor: Vivian L. Prenger, Santa Ana, Calif.

[73] Assignee: Accent Industries, Santa Ana, Calif.

[21] Appl. No.: 46,555

[22] Filed: Jun. 7, 1979

[51] Int. Cl.[3] ..... A47H 1/10

[52] U.S. Cl. ..... 248/318; 47/67

[58] Field of Search ..... 248/317, 318; 47/67, 47/39

[56] References Cited

U.S. PATENT DOCUMENTS

| | | | |
|---|---|---|---|
| 1,600,931 | 9/1926 | Chatham | 248/318 |
| 2,156,831 | 5/1939 | Andre | 248/317 X |
| 2,533,845 | 12/1950 | Stender | 248/318 |
| 3,228,577 | 1/1966 | Croft | 248/318 UX |
| 3,854,242 | 12/1974 | Gladstein | 248/318 X |
| 3,915,419 | 10/1975 | Brown et al. | 248/318 |
| 3,981,099 | 9/1976 | Dziewulski | 47/67 |
| 4,032,102 | 6/1977 | Wolf | 248/318 |
| 4,084,779 | 4/1978 | Moineau | 248/318 |
| 4,117,630 | 10/1978 | Kalas | 47/67 |
| 4,147,320 | 4/1979 | Biedebach | 248/318 |

FOREIGN PATENT DOCUMENTS

| | | | |
|---|---|---|---|
| 1200371 | 7/1970 | United Kingdom | 47/67 |

*Primary Examiner*—J. Franklin Foss

*Attorney, Agent, or Firm*—Knobbe, Martens, Olson, Hubbard & Bear

[57] ABSTRACT

A plant hanger of the type made from knotted yarn has a base which is suspended from a ring by a plurality of support elements, one of which is permanently attached to the ring, while the remaining support elements are removably attached to the ring so that a plant receptacle may be easily placed in or removed from the hanger by simply removing the support elements from the ring.

3 Claims, 4 Drawing Figures

PLANT HANGER

BACKGROUND OF THE DISCLOSURE

Macrame (knotted yarn) plant hangers have become increasingly popular in recent years. Typically, such plant hangers have a base or bottom portion for carrying a flower pot or similar plant receptacle. Attached at various points around the perimeter of the base section are a plurality of elongate yarn appendages which are typically knotted together at the other end to form a loop. The hanger is typically suspended by the loop from a hook which is mounted in a suitable support structure, such as a wall or ceiling.

While the decorative effect achieved by the use of the plant hangers is pleasing to many, it has been found that the placing of a flower pot into the hanger or removing it therefrom can be quite troublesome. Specifically, the flower pot or plant receptacle must be moved between the aforementioned appendages in order to be placed into or removed from the hanger. These appendages are frequently relatively closely spaced, and, consequently, the insertion of removal process can result in damage to delicate leaves, blossoms, etc. Even if such damage does not result, the use of these prior art plant hangers is at best cumbersome, because of their particular manner of construction.

Accordingly, the need has arisen for a plant hanger which allows quick and easy insertion and removal of the plant receptacle without exposing the plant to damage during the process.

SUMMARY OF THE INVENTION

In accordance with the present invention, a plant hanger of the macrame or knotted yarn type is provided, where at least some of the base-supporting yarn appendages are removably attached to a ring which serves the function of the aforementioned loop. In the preferred embodiment of the invention, only one of the appendages is permanently attached to the ring, while the remaining appendages are removably attached to the ring by means of hooks.

When it is desired to place a plant in or remove a plant from the plant hanger constructed in accordance with the present invention, the removably attached appendages are simply unhooked from the ring, thereby allowing an unobstructed access to or from the base member. The insertion or removal of a plant receptacle can thus be accomplished quickly and easily without fear of damaging the plant in any way. Moreover, this result is accomplished in a manner which maintains the aesthetic qualities of the plant hanger while enhancing the utility thereof.

DETAILED DESCRIPTION OF THE INVENTION

Figure 1:
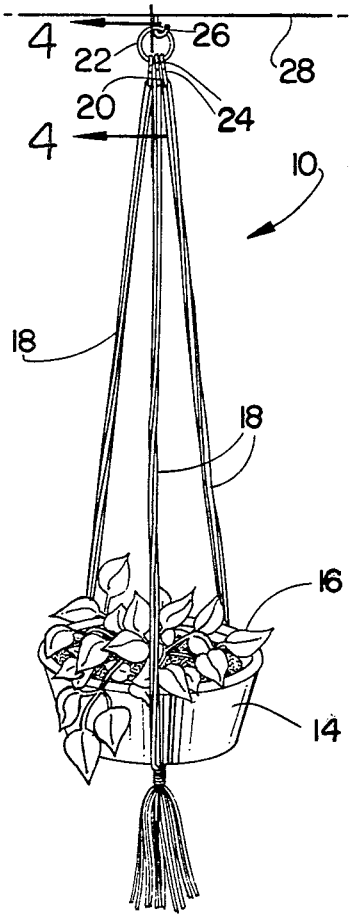
FIG. 1 is a perspective view of a plant hanger constructed in accordance with the present invention showing the hanger in use carrying a plant receptacle.
Figure 3:
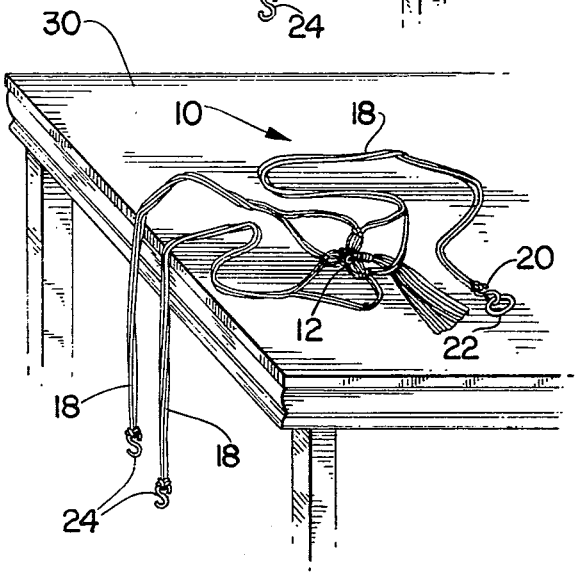
FIG. 3 is a perspective view showing the plant hanger of the present invention in its disassembled state with the plant receptacle removed.

Referring first to FIGS. 1 and 3, a plant hanger 10 constructed in accordance with the present invention is formed from a network of knotted yarn or rope in the manner commonly referred to as macrame. The hanger 10 has a base or bottom member 12 (FIG. 3) on which is carried a plant receptacle such as a flower pot 14 containing a plant 16. Attached to the base element 12 at several points around the periphery thereof is a plurality of elongate support elements or appendages 18, each comprising a multiplicity of yarn strands. As shown in the drawings, three such appendages 18 are provided, and this is considered to be the optimum number. However, more than this number may be used, if desired, to achieve various ornamental effects.

Figure 2:
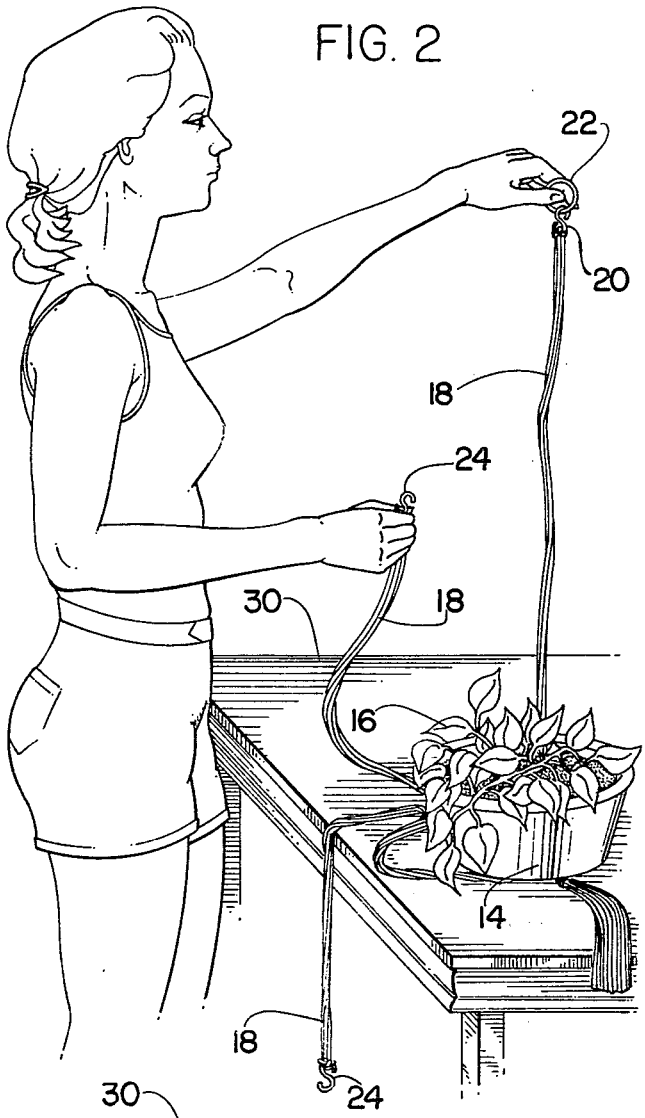
FIG. 2 is a perspective view showing the process of removing the plant receptacle from the hanger.
Figure 4:
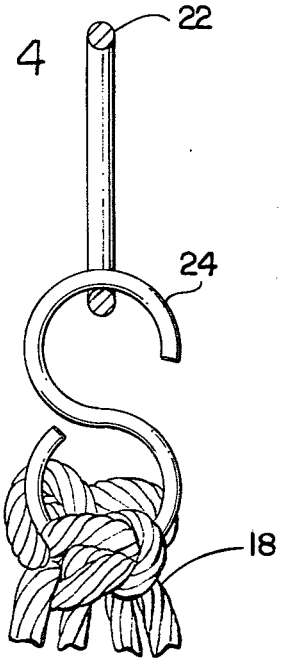
FIG. 4 is a sectional view along line 4—4 of FIG. 1 showing the details of the means for removably attaching the appendages to the ring.

As best shown in FIGS. 2 and 4, one of the support appendages 18 is permanently attached by a connection link 20 to a loop-forming member, preferably a ring 22. Each of the two remaining support appendages 18 terminates in an S-shaped hook 24 which is removably engageable with the ring 22 as shown in FIG. 4.

Having fully described the structure of the invention, its manner of use will now be more easily understood. As shown in FIG. 1, the plant hanger 10 is suspended by the ring 22 from a hook 26 which is mounted in a structural member such as a ceiling 28. When it is desired to remove the plant receptacle 14 containing the plant 16, the ring 22 is removed from the hook 26 and the base member 12 with the receptacle or pot 14 is rested on a surface such as a table 30 while a grasp is maintained on the ring 22. The S-shaped hooks 24 on the ends of the two detachable appendages are then removed from the ring 22. Finally, the ring 22 is released and the plant receptacle 14 is simply lifted off of the base member 12 without any obstruction being presented by the appendages 18 which could cause damage to the plant 16.

The above procedure is merely reversed for the placing of a plant receptacle into the hanger.

It will be observed that all three of the support appendages 18 could be provided with S-shaped hooks 24 so as to be removably attachable to the ring 22. However, it is advantageous to permanently connect at least one of the appendages 18 to the ring 22 by such means as the connecting link 20, so that the ring 22 cannot become spearated from the hanger and lost. Alternatively, the connecting link 20 can be eliminated and the one appendage 18 directly tied to the ring 22.

What is claimed is:

1. A plant hanger comprising:

means forming a base for supporting a plant receptacle, said base including a portion which extends below said plant receptacle to support said receptacle and being formed of a knotted yarn network which is sufficiently flexible to conform, without adjustment, to plant receptacles of varying sizes and shapes and to allow removal of said receptacle without adjustment;

a ring; and plural elongate, flexible support members, each formed of a knotted yarn network and attached at one end to said base-forming means, the other end of all but one of said support members being removably attachable to said ring by a hook, and the other end of said one of said support members being non-removably attached to said ring.

2. A plant hanger for suspending a plant receptacle from a supporting surface comprising:

plural elongate flexible support members each extending:

(a) at one end from a common connector supported from said supporting surface;

(b) at the other end from a common position centrally located along the bottom of said receptacle; and (c) for an intermediate portion of their length from said common position radially outward along the bottom of said receptacle and upward toward said common connector along the sides of said receptacle, said support members each formed of interwoven fibrous strands sufficiently flexible to conform without adjustment to plant receptacles of differing sizes and shapes; and means mounted to at least one of said plural elongate flexible support members for easily removably attaching said at least one of said support members to said common connector independent of the remaining ones of said support members.

3. A plant hanger comprising:

means forming a base for supporting a plant receptacle, said base including a first portion extending along the sides of said plant receptacle and a second portion extending along the bottom of said receptacle;

a connector adapted to be supported from a supporting surface;

plural elongate support members extending between said connector and base for suspending said base from said connector;

means for easily removably attaching at least one of said elongate support members to said connector independent of the remaining ones of said support members; and said base and said plural elongate support members being formed of fibrous strands sufficiently flexible to readily conform to plant receptacles of differing sizes and shapes and permit said at least one of said elongate support members to be separated from said remaining ones of said support members and be extended radially outward about said base to facilitate insertion and removal of a plant from said plant receptacle without damaging the foilage of said plant.

* * * * *